US008104594B2

(12) United States Patent
Chisholm

(10) Patent No.: US 8,104,594 B2
(45) Date of Patent: Jan. 31, 2012

(54) CASE, SYSTEM AND/OR METHOD FOR STORING AND/OR FOR TRANSPORTING ARTICLES

(75) Inventor: Claudia Chisholm, Northbrook, IL (US)

(73) Assignee: Kingport Industries, LLC, Northbrook, IL (US)

( * ) Notice: Subject to any disclaimer, the term of this patent is extended or adjusted under 35 U.S.C. 154(b) by 562 days.

(21) Appl. No.: 12/290,314

(22) Filed: Oct. 29, 2008

(65) Prior Publication Data

US 2010/0101971 A1 Apr. 29, 2010

(51) Int. Cl.

| | |
|---|---|
| ***A45C 5/14*** | (2006.01) |
| ***A45C 13/00*** | (2006.01) |
| ***A45C 13/40*** | (2006.01) |
| ***B65D 1/24*** | (2006.01) |

(52) U.S. Cl. ..... 190/112; 190/18 A; 190/102; 190/109; 190/110; 220/530; 206/526

(58) Field of Classification Search ..... 190/18 A, 190/102, 109, 110, 112; 206/320, 526, 576; 220/530

See application file for complete search history.

(56) References Cited

U.S. PATENT DOCUMENTS

| | | | | |
|---|---|---|---|---|
| 5,676,223 | A * | 10/1997 | Cunningham | 190/109 |
| 5,875,876 | A * | 3/1999 | Wang | 190/18 A |
| 6,102,172 | A * | 8/2000 | Dercole | 190/18 A |
| 2002/0000390 | A1 * | 1/2002 | Hollingsworth | 206/320 |

OTHER PUBLICATIONS

"The Three Suit Rolling Garment Case", Hammacher Schlemmer Online Catalog, www.hammacher.com/publish/76416.asp, May 2009.

* cited by examiner

*Primary Examiner* — Anthony Stashick
*Assistant Examiner* — Madison L Wright
(74) *Attorney, Agent, or Firm* — Patents+TMS, P.C.

(57) ABSTRACT

A case, a system and/or a method for storing and/or for transporting articles are provided. The case, the system and/or the method operate to store and/or to transport articles, such as, for example, office-related articles and personal articles. A first compartment forms a first volume that may be protected by walls of the case. Further, a second compartment forms a second volume. The second compartment extends into the first volume of the first compartment. The second compartment receives and/or stores the articles towards the interior of the first compartment. The second compartment has a divider for maintaining a position of the articles in the second compartment and restricts movement of the articles outward with respect to the interior of the first compartment. The second compartment is opened to form a tray for accessing one or more of the articles without opening the first compartment.

20 Claims, 2 Drawing Sheets

CASE, SYSTEM AND/OR METHOD FOR STORING AND/OR FOR TRANSPORTING ARTICLES

BACKGROUND OF THE INVENTION

The present invention generally relates to a case, a system and/or a method for storing and/or for transporting articles. More specifically, the present invention relates to a case, a system and/or a method for storing and/or for transporting articles, such as, for example, office-related articles. The case, the system and/or the method may have a first compartment that may form a first volume of space that may be protected by one or more walls of the case. Further, the case, the system and/or the method may have a second compartment that may form a second volume. The second compartment may be accessible through one of the walls and may extend into the first volume of the first compartment. The second compartment may be sized to receive one or more of the articles. Moreover, the second compartment may be opened to form a tray for accessing one or more of the articles that may be stored in the second compartment.

It is generally known that luggage, such as, for example, suitcases, trolley cases, briefcases, duffel bags, backpacks and/or the like are used to store and/or transport belongings. Luggage is used to transport the belongings by foot and/or in automobiles, trains, busses, airplanes and/or the like. Further, it is known that luggage may be constructed in carrier-approved sizes to allow for maximum carrying capability within the overhead compartment size constraints of commercial airplanes, busses and/or trains.

Further, it is generally known that business travelers often need to store and transport office-related accessories and/or supplies on business trips by foot and/or in automobiles, trains, busses, airplanes and/or the like. The office-related accessories may be, for example, books, files, documents, pens, pencils, business cards, product demos, marketing displays and/or fixtures and/or portable electronic devices, such as, for example, laptop computers, PDAs, cell phones, electronic music players, power adaptors and/or the like. Still further, business travelers often need to store and/or transport personal belongings, such as, for example, clothes and/or toiletries along with the office-related accessories. Often, portable electronic devices, such as, for example, laptop computers, cell phones and/or PDAs may require removal from luggage for security screening at transportation hubs, such as, for example, at airports, train stations and/or the like. Still further, portable electronic devices, such as, for example, laptop computers, cell phones and/or PDAs must be easily accessible to be used, powered off and/or disabled during portions of airplane flights. Moreover, the office-related accessories may require access, for example, during transportation and/or after the traveler has arrived at his or her destination.

As a result, known luggage is provided with various external pockets that may be more accessible than a rigidly protected main compartment of the luggage. To access the contents that are protected by the main compartment of the known luggage, the entire case must be opened. The external pockets of the known luggage have a space between two sheets of luggage material. The external pockets are formed by attaching the sheets of luggage material. Therefore, the external pockets provide minimal depth for receiving contents, and a volume of the external pockets tapers at the perimeter where the two sheets of material are attached. Further, the external pockets provide minimal or no rigid protection of the contents and form spaces having less carrying capacity than the main compartment. As a result, travelers are reluctant to stow delicate electronic devices, other fragile contents and/or sensitive documents in the various external pockets because of the risk of damage during transportation. Alternatively, travelers often use, for example, a suitcase, a trolley system and/or a duffel bag to store and transport personal belongings and use a separate bag, such as, for example a briefcase, a backpack, a tote bag and/or a laptop case to transport office-related accessories.

A need, therefore, exists for a case, a system and/or a method for storing and/or for transporting articles. Additionally, a need exists for a case, a system and/or a method for storing and/or for transporting office-related articles, such as, for example, books, files, documents, pens, pencils, business cards, product demos, marketing displays and/or fixtures and/or portable electronic devices, such as, for example, laptop computers, PDAs, cell phones, electronic music players, power adaptors and/or the like. Further, a need exists for a case, a system and/or a method for storing and/or for transporting articles that may reduce a number of luggage items required to store and/or transport the articles. Further, a need exists for a case, a system and/or a method for storing and/or for transporting articles that may have a first compartment defining an interior of the case and a second compartment that extends from an exterior of the case into the first compartment of the case. Further, a needs exists for a case, a system and/or a method that may have a second compartment that may be accessible from an exterior of the case for storing and/or retrieving contents that may be stored in a volume of the first compartment without opening the first compartment. Further, a need exists for a case, a system and/or a method that may provide protection for fragile articles stored in the second compartment. Further, a need exists for a case, a system and/or a method that may have a tray that opens to access the second compartment in instances wherein the first compartment of the case cannot be opened due to time and/or space constraints.

SUMMARY OF THE INVENTION

The present invention generally relates to a case, a system and/or a method for storing and/or for transporting articles. More specifically, the present invention relates to a case, a system and/or a method for storing and/or for transporting articles, such as, for example, office-related articles. The office-related articles may be, for example, documents, newspapers, portable electronic devices, power cabling, books, magazines, writing utensils, files, clothing, toiletries and/or the like. The case, the system and/or the method may have a first compartment that may form a first volume of space that may be protected by one or more walls of the case. The first compartment may be accessible by a first flap that may form one of the walls of the case. The first flap may be fastened to the case with a fastener, such as, for example, a zipper system. Moreover, the case, the system and/or the method may have a second compartment that may be accessible from a second flap that may be positioned on the first flap. The second flap may be fastened to the first flap with a fastener, such as, for example, a zipper system.

The second compartment may form a second volume and/or may extend into the first volume of the first compartment when the case is situated in a closed position; therefore, any contents of the second compartment may be protected by the walls of the case that may form the first compartment. The second compartment may be sized to receive one or more of the articles. Moreover, the second compartment may be padded to further protect one or more of the articles. The second flap may be connected to the first flap with one or more webbings. Therefore, the second flap may be opened to form a tray for allowing access to the second compartment.

Further, the second compartment may have a divider that may have various pockets and/or holders for receiving and/or for storing one or more of the articles. Further, the divider may be secured within the second compartment to restrict one or more of the articles within the volume of the first compartment towards a back of the second compartment and away from the second flap. The divider may be unsecured to allow access to the articles stored within the volume of the first compartment toward the back of the second compartment.

Moreover, the case, the system and/or the method may have a shuttle bag that may be sized to fit within the second compartment adjacent to the divider and within the volume of the first compartment toward the back of the second compartment. The shuttle bag may receive, for example, a laptop computer and/or other article and may be padded to further protect the same.

To this end, in an embodiment of the present invention, a case for storing and accessing a first type of articles and a second type of articles wherein the first type of articles are stored in and accessed from the case separately from the second type of articles is provided. The case has a first compartment having a plurality of walls wherein the compartment has a first volume defined by the plurality of walls. Further, the case has a first flap that forms a portion of one of the plurality of walls wherein the first compartment is accessible via the first flap. Still further, the case has a second flap having a length defined between a top end and a bottom end wherein the bottom end of the second flap is positioned opposite to the top end of the second flap wherein the second flap has a width defined between a first end and a second end wherein the second end of the second flap is positioned opposite the first end of the second flap wherein the second flap forms a portion of the first flap wherein the bottom end of the second flap is attached to the bottom end of the first flap. Still further, the case has a second compartment accessible via the second flap having a length defined between a top end and a bottom end wherein the bottom end of the second compartment is positioned opposite to the top end of the second compartment wherein the second compartment has a width defined between a first end and a second end wherein the second end of the second compartment is positioned opposite to the first end of the second compartment wherein the second compartment has a depth defined between the second flap and a back side wherein the back side of the second compartment is positioned opposite to the second flap wherein the second compartment extends from the first flap into the first volume of the first compartment wherein the second compartment is accessible without accessing the first compartment. Moreover, the case has a divider having a length defined between a top end and a bottom end wherein the bottom end of the divider is positioned opposite to the top end of the divider wherein the bottom end of the divider is attached to the bottom end of the second compartment between the second flap and the back side of the second compartment.

In an embodiment, the case has a fastener attaching the top end of the divider to the top end of the compartment between the second flap and the back side of the second compartment.

In an embodiment, the case has a fastener securing the first flap to one of the plurality of walls of the first compartment.

In an embodiment, the case has a fastener securing the first end of the second flap, the top end of the second flap and the second end of the second flap to the first flap.

In an embodiment, the case has a webbing attaching the first end of second flap to the second compartment.

In an embodiment, the case has a pocket on the divider wherein the pocket has a cavity wherein the cavity stores the second type of articles.

In an embodiment, the case has a wheel attached to one of the plurality walls of the first compartment wherein the wheel rotates.

In an embodiment, the case has a bag attached to one of the plurality of walls within the first compartment wherein the bag has a cavity to store the first type of articles.

In another embodiment, a system for transporting a plurality of articles wherein one of the plurality of articles is separated from a remainder of the plurality of articles and is accessible without accessing the remainder of the plurality of articles is provided. The system has a case having a first volume defined by a plurality of walls wherein the first volume of the case is accessible via one of the plurality of walls. Further, the system has a compartment having a depth defined between one of the plurality of walls of the case and a back side of the compartment wherein the back side of the compartment is positioned opposite to one of the plurality of walls of the case wherein the compartment has a second volume wherein the compartment extends into the case penetrating the first volume wherein the second volume is less than the first volume wherein the compartment is accessible via one of the plurality of walls. Still further, the system has a divider having a top end and a bottom end wherein the bottom end of the divider is positioned opposite to the top end of the divider wherein the bottom end of the divider is attached to an interior of the compartment between one of the plurality of walls and the back side of the compartment wherein the divider separates the compartment into a front portion and a rear portion wherein the rear portion is adjacent to the back side of the compartment and the front portion is adjacent to one of the plurality of walls of the case. Moreover, the system has a bag to receive one of the plurality of articles wherein the bag is sized to fit within the rear portion of the compartment between the divider and the back side of the compartment.

In an embodiment, the system has a fastener securing one of the plurality of walls to the case.

In an embodiment, the system has a flap formed with one of the plurality of walls wherein the flap has a top end and a bottom end wherein the bottom end is positioned opposite to the top end wherein the flap has a first end and a second end wherein the second end is positioned opposite to the first end wherein the bottom end is attached to one of the plurality of walls wherein the top end of the flap, the first end of the flap and the second end of the flap have a fastener securing the flap to one of the plurality of walls wherein the fastener is disengaged to access the compartment.

In an embodiment, the system has an opening in the bag wherein the opening is sized to receive one of the plurality of articles.

In an embodiment, the system has a padded material forming the bag wherein the padded material is compressible.

In an embodiment, the system has a padded material forming the compartment wherein the padded material is compressible.

In an embodiment, the system has a non-rigid material forming the compartment wherein the back side of the compartment is movable toward one of the plurality of walls of the case.

In an embodiment, the system has a fastener attaching the top end of the divider to the interior of the compartment.

In another embodiment, a method for storing a plurality of articles in a case wherein the case has a main compartment accessible by a first flap and a volume defined by a plurality of walls of the case wherein the case has a secondary compartment accessible by a second flap located on the first flap wherein the secondary compartment extends from one of the plurality of walls of the case into the volume of the main compartment to a back side of the secondary compartment wherein the main compartment is not accessible via the secondary compartment and further wherein the case has a divider to segregate the second compartment is provided. The method has the step of opening the main compartment with the first flap. Further, the method has the step of placing one of the plurality of articles in the main compartment. Still further, the method has the step of closing the main compartment with the first flap. Still further, the method has the step of opening the secondary compartment with the second flap. Still further, the method has the step of placing one of the plurality of articles within the secondary compartment adjacent to the back side of the secondary compartment and entirely within the volume of the main compartment. Still further, the method has the step of securing the divider to the secondary compartment to restrict movement of the article away from the back side of the secondary compartment and outside the volume of the main compartment. Moreover, the method has the step of closing the secondary compartment with the second flap.

In an embodiment, the method has the step of securing the second flap to the first flap.

In an embodiment, the method has the step of compressing the secondary compartment to increase the volume of the main compartment.

In an embodiment, the method has the step of securing the first flap to one of the plurality of walls.

It is, therefore, an advantage of the present invention to provide a case, a system and/or a method for storing and/or for transporting articles.

Another advantage of the present invention is to provide a case, a system and/or a method for storing and/or for transporting office-related articles, such as, for example, books, files, documents, pens, pencils, business cards, product demos, marketing displays and/or fixtures and/or portable electronic devices, such as, for example, laptop computers, PDAs, cell phones, electronic music players, power adaptors and/or the like.

And, another advantage of the present invention is to provide a case, a system and/or a method for storing and/or for transporting articles that may have a first compartment that may form a first volume defining an interior of the case and a second compartment that extends from an exterior of the case into the first volume within the case.

Yet another advantage of the present invention is to provide a case, a system and/or a method for storing and/or for transporting articles that may have a second compartment that may be accessible from an exterior of the case for storing and/or retrieving contents that may be stored in a volume of the first compartment without opening the first compartment.

A further advantage of the present invention is to provide a case, a system and/or a method for storing and/or for transporting articles that may provide protection for fragile articles stored in the second compartment.

Moreover, an advantage of the present invention is to provide a case, a system and/or a method for storing and/or for transporting articles that may have a tray that opens to access the second compartment in instances wherein the first compartment of the case cannot be opened due to time and/or space constraints.

And, another advantage of the present invention is to provide a case, a system and/or a method for storing and/or for transporting articles that may be a carrier-approved size for stowing in, for example, overhead compartments of planes, trains and/or busses.

Yet another advantage of the present invention is to provide a case, a system and/or a method for storing and/or for transporting articles that may have a divider in the second compartment to separate articles and/or to secure one or more of the articles towards an interior of the case.

Another advantage of the present invention is to provide a case, a system and/or a method for storing and/or for transporting articles that may allow for access to the articles while the case may be located in, for example, an overhead compartment of a plane, a train and/or a bus and/or other location with limited space for opening the case.

Yet another advantage of the present invention is to provide a case, a system and/or a method for storing and/or for transporting articles that may allow for separation of personal articles from office-related articles wherein the office-related articles may be accessed while the personal articles remain stowed.

A still further advantage of the present invention is to provide a case, a system and/or a method for storing and/or for transporting articles that may have a bag in the second compartment to further protect an article, such as, for example, a laptop computer.

Moreover, an advantage of the present invention is to provide a case, a system and/or a method for storing and/or for transporting articles that may reduce a number of luggage items required to store and/or transport the articles.

And, another advantage of the present invention is to provide a case, a system and/or a method for storing and/or for transporting articles that may have wheels and/or a handle for maneuvering articles.

Yet another advantage of the present invention is to provide a case, a system and/or a method for storing and/or for transporting articles that may allow for access to the articles, such as, for example, electronic devices at security screening checkpoints in transportation depots, such as, for example, at airports, bus stations and/or train stations.

Moreover, an advantage of the present invention is to provide a case, a system and/or a method for storing and/or for transporting articles wherein the case and/or the system may appear to be a single-compartment trolley case when situated in a closed position.

And, another advantage of the present invention is to provide a case, a system and/or a method for storing and/or for transporting articles that may be used in a meeting and/or on a trip.

Yet another advantage of the present invention is to provide a case, a system and/or a method for storing and/or for transporting articles that may allow access to articles without opening a main compartment of the case.

Additional features and advantages of the present invention are described in, and will be apparent from, the detailed description of the presently preferred embodiments and from the drawings.

DETAILED DESCRIPTION OF THE PRESENTLY PREFERRED EMBODIMENTS

Figure 2:
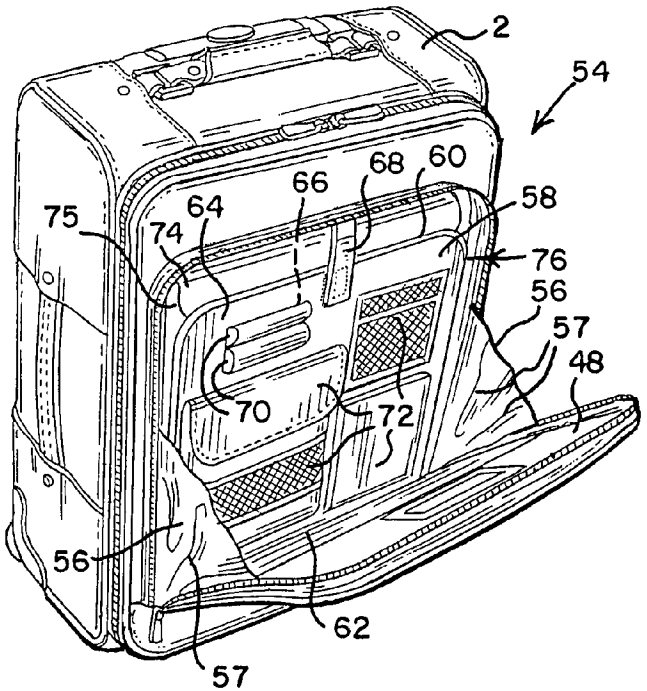
FIG. 2 illustrates a perspective view of a system for storing and/or for transporting articles in an embodiment of the present invention.

The present invention generally relates to a case, a system and/or a method for storing and/or for transporting articles. More specifically, the present invention relates to a case, a system and/or a method for storing and/or for transporting articles, such as, for example, personal articles and/or office-related articles. The personal articles may be, for example, clothing, toiletries and/or the like. The office-related articles may be, for example, documents, business cards, stamps, newspapers, portable electronic devices, power cabling, storage media, books, magazines, writing utensils, files and/or the like. The portable electronic devices may be, for example, laptop computers, personal data assistants (PDAs), cellular telephones, digital music players, voice recorders, projectors, power adapters and/or the like.

Referring now to the drawings wherein like numerals refer to like parts, FIGS. 1-4 generally illustrate a case 2 for storing and/or for transporting articles 80. It should be understood that the articles 80 may be any articles that may be transported as known to one having ordinary skill in the art.

Figure 1:
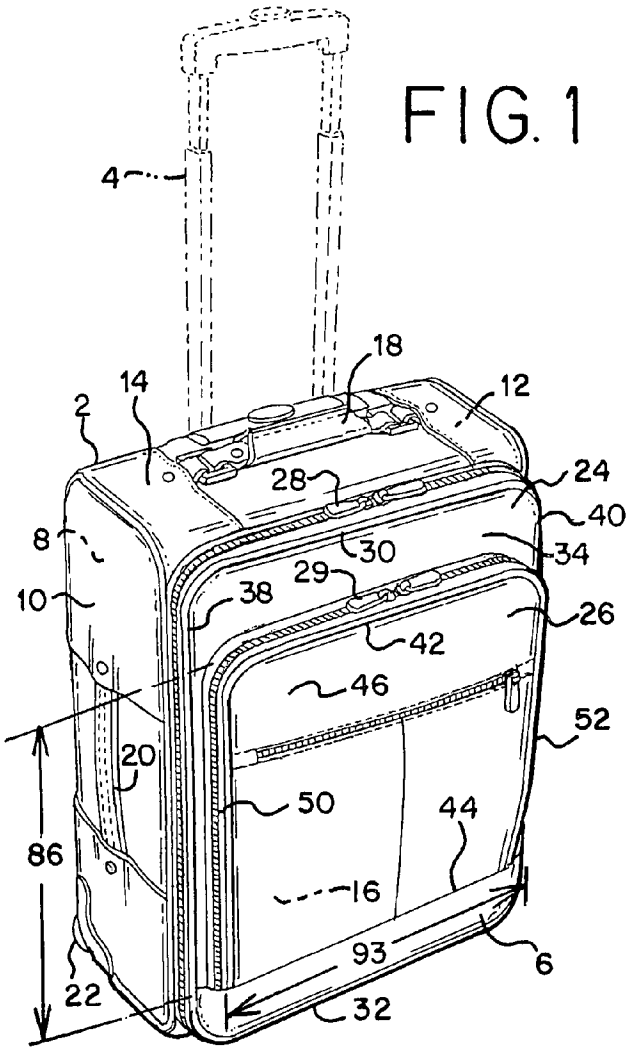
FIG. 1 illustrates a perspective view of a case for storing and/or for transporting articles in an embodiment of the present invention.
Figure 4:
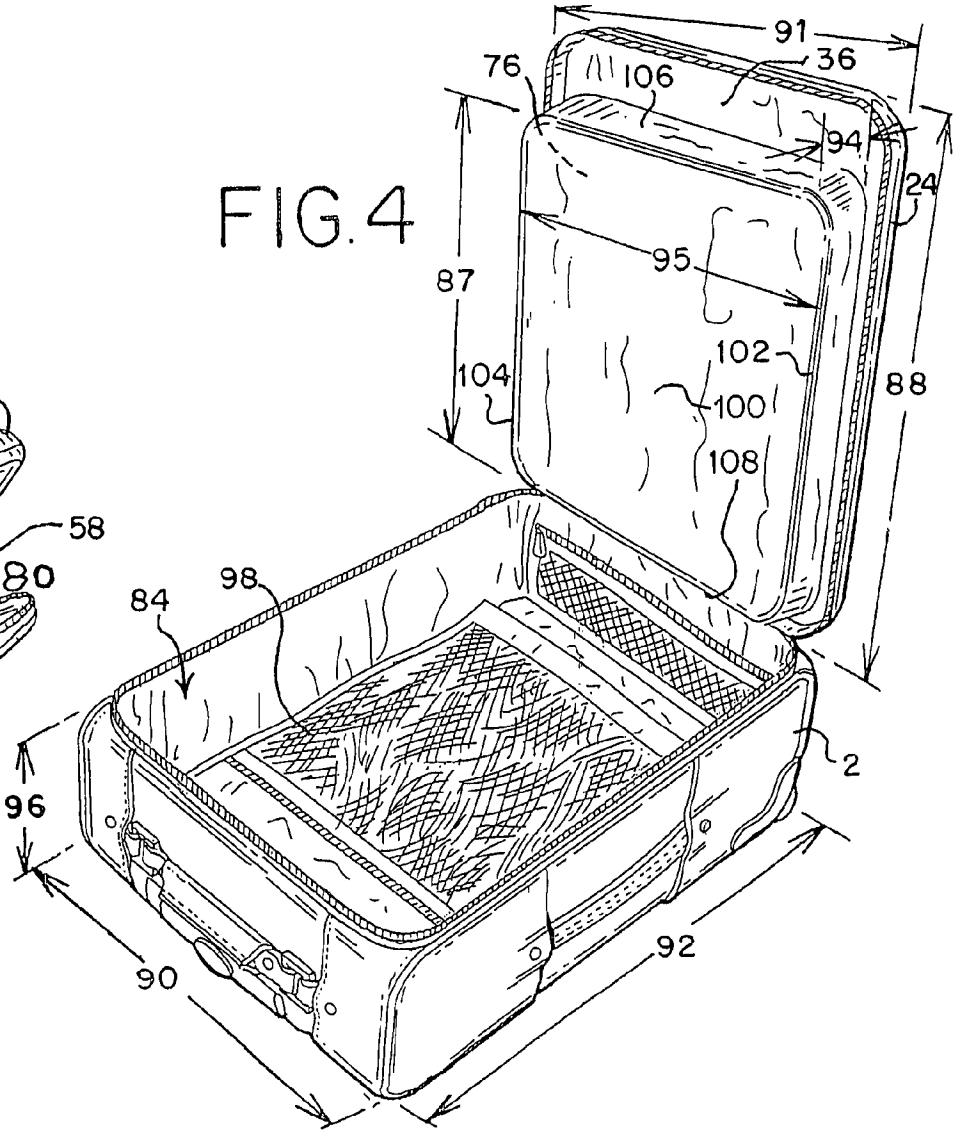
FIG. 4 illustrates a perspective view of a case for storing and/or for transporting articles in an embodiment of the present invention.

As illustrated in FIGS. 1 and 4, the case 2 may have a length 92 defined between walls 14, 16; a width 90 defined between walls 10, 12; and a depth 96 defined between walls 6, 8. The walls 6, 8, 10, 12, 14, 16 of the case 2 may form a first compartment 84 having a first volume defined by the length 92, the width 90 and the depth 96. The walls 6, 8, 10, 12, 14, 16 may be constructed from a rigid and/or a semi-rigid material, such as, for example, steel, aluminum, titanium, leather, plastic and/or like material that may protect contents of the case 2. The walls 6, 8, 10, 12, 14, 16 may be a composition of layers of materials for luggage construction. The case 2 may be constructed in a carrier-approved luggage size, such as, for example, a carry-on size allowed by an airline carrier. It should be understood that the case 2 and/or the walls 6, 8, 10, 12, 14, 16 may be constructed from any material suitable for luggage construction as known to one having ordinary skill in the art. The present invention should not be deemed as limited to a specific embodiment of the walls 6, 8, 10, 12, 14, 16. Further, it should be understood that the case 2 may be constructed in any size as known to one having ordinary skill in the art. The present invention should not be deemed as limited to a specific size of the case 2.

The case 2 may have two or more wheels 22 to maneuver the case 2 on one or more types of surface. The case 2 may have a retractable handle 4 to steer, to pull and/or to push the case 2 on the wheels 22. The case 2 may have a handle 18 attached to the wall 14 to aid in lifting and/or maneuvering the case 2. The case 2 may have a handle 20 attached to the wall 10 to aid in lifting and/or maneuvering the case 2. It should be understood that the wheels, the retractable handle 4, the handle 18 and/or the handle 20 may be any wheel, retractable handle and/or handles, respectively, as known to a one having ordinary skill in the art.

As illustrated in FIGS. 1-4, the first compartment 84 may be accessible by a first flap 24 that may form a portion of the wall 6 of the case 2. The first flap 24 may have a length 88 defined between a top end 30 and bottom end 32 that may be positioned opposite to the top end 30. Further, the first flap 24 may have a thickness defined between a front side 34 and a back side 36 that may be positioned opposite to the front side 34. Further, the first flap 24 may have a width 91 defined between a first end 38 and a second end 40 that may be positioned opposite to the first end 38. The bottom end 32 of the first flap 24 may be attached to and/or continuously formed with the case 2.

In an embodiment, the first end 38, the top end 30 and the second end 40 of the first flap 24 may be removably fastened to the case 2 with a fastener 28, such as, for example, a zipper system, a hook and loop fastener, a button, a snap, a strap, a magnetic latch and/or the like. The fastener 28 may be disengaged at the first end 38, the top end 30 and the second end 40 to open the case 2 to expose the first compartment 84. Likewise, the fastener 28 may be engaged at the first end 38, the top end 30 and the second end 40 to close the case 2 to secure the first compartment 84. It should be understood that the bottom end 32 of the first flap 24 may be attached and/or formed with the case 2 in any fashion as known to one having ordinary skill in the art. Further, the fastener 28 may be any fastener suitable for luggage construction as known to one having ordinary skill in the art. The present invention should not be deemed as limited to a specific embodiment of the fastener 28.

As illustrated in FIGS. 1-4, the case 2 may have a second compartment 76 that may be accessible by a second flap 26 that may form a portion of the first flap 24. The second flap 26 may have a length 86 defined between a top end 42 and a bottom end 44 that may be positioned opposite to the top end 42. Further, the second flap 26 may have a thickness defined between a front side 46 and a back side 48 that may be positioned opposite to the front side 46. Further, the second flap 26 may have a width 93 defined between a first end 50 and a second end 52 that may be positioned opposite to the first end 50. The length 86 of the second flap 26 may be less than the length 88 of the first flap 24. The thickness of the second flap 26 may be approximately equivalent to the thickness of the first flap 24. The width 93 of the second flap 26 may be less than the width 91 of the first flap 24. The bottom end 44 of the second flap 26 may be attached to and/or continuously formed with the first flap 24 that may be adjacent to the bottom end 32 of the first flap 24.

In an embodiment, the first end 50, the top end 42 and the second end 52 of the second flap 26 may be removably fastened to the first flap 24 with a fastener 29, such as, for example, a zipper system, a hook and loop fastener, a button, a snap, a strap, a magnetic latch and/or the like. The fastener 29 may be disengaged at the first end 50, the top end 42 and the second end 52 to open the case 2 to expose the second compartment 76. Likewise, the fastener 29 may be engaged at the first end 50, the top end 42 and the second end 52 to close the case 2 to secure the second compartment 76. The fastener 29 may be any fastener suitable for luggage construction as known to one having ordinary skill in the art. The present invention should not be deemed as limited to a specific embodiment of the fastener 29.

Figure 3:
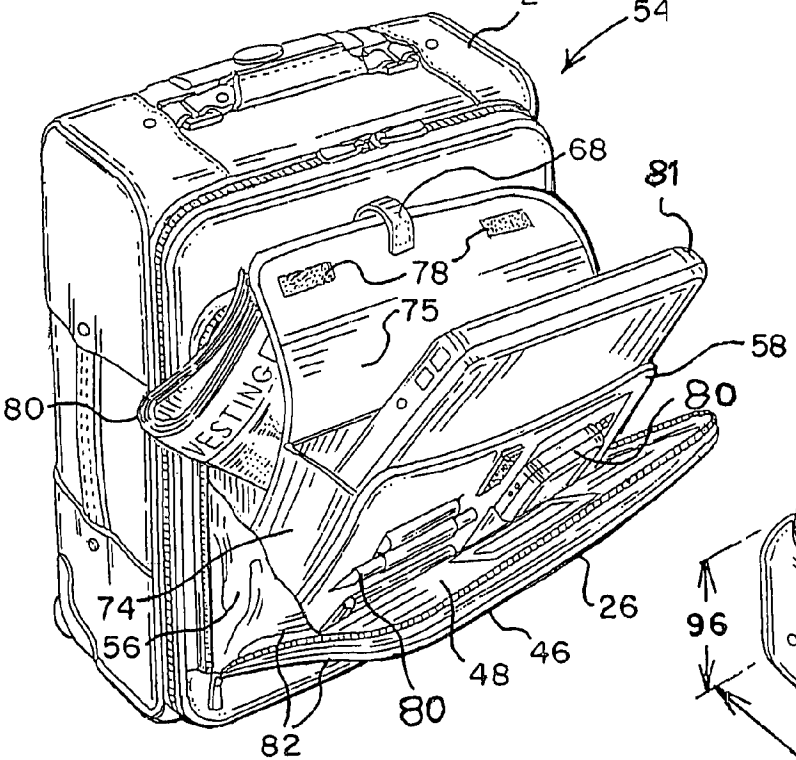
FIG. 3 illustrates a perspective view of a system for storing and/or for transporting articles in an embodiment of the present invention.

As illustrated in FIGS. 2 and 3, the back side 48 of the second flap 26 may be attached to the first flap 24 by webbings 56 at the first end 50 and the second end 52 of the second flap 26. The webbings 56 may be, for example, a foldable and/or pliable material, such as, for example, nylon and/or the like. The webbings 56 may have one or more creases 57 to allow the webbings 56 to fold. In an embodiment, the webbings 56 may fold inward between the back side 48 of the second flap 26 and the second compartment 76 when the second flap 26 is maneuvered adjacent to the first flap 24. When the case 2 is situated in an upright position as illustrated in FIG. 2, the second flap 26 may be unfastened from the first flap 24 and moved outward with respect to the first flap 24. In an embodiment, the top end 42 of the second flap 26 may rotate about the bottom end 44 of the second flap 26. The bottom end 44 of the second flap 26 may be attached to the bottom end 32 of the first flap 24.

In an embodiment, the second flap 26 opens a distance from the first flap 24 which may extend the webbings 56 to resist further opening of the second flap 26. As a result, in an open position as illustrated in FIGS. 2 and 3, the second flap 26 may form a tray 82 for receiving and/or removing the articles 80 from the second compartment 76. It should be understood that the webbings 56 may be constructed from any material suitable for allowing the second flap 26 to open to form a tray with the first flap 24 as known to one having ordinary skill in the art. The present invention should not be deemed as limited to a specific embodiment of the webbings 56.

As shown in FIG. 4, the second compartment may have a length 87 defined between a top end 106 and a bottom end 108 that may be positioned opposite to the top end 106; a width 95 defined between a first end 102 and a second end 104 that may be positioned opposite to the first end 102; and a depth 94 defined between the second flap 26 and a back side 100 that may be positioned opposite to the second flap 26. The second compartment 76 of the case 2 may have a second volume defined by the length 87, the width 95 and the depth 94. In an embodiment, the second volume of the second compartment 76 may be greater than ten percent of the of the first volume of the first compartment 84.

The top end 106, the bottom end 108, the first end 102 and the second end 104 of the second compartment 76 may be constructed from the same material and/or materials. The top end 106, the bottom end 108, the first end 102 and the second end 104 of the second compartment 76 may be constructed from a rigid and/or a semi rigid material, such as, for example, steel, aluminum, titanium, leather, plastic, nylon and/or like material that may be suitable for protecting contents of the second compartment 76 of the case 2. The top end 106, the bottom end 108, the first end 102 and the second end 104 of the second compartment 76 may be a constructed from a plurality of materials that may be suitable for luggage construction. The top end 106, the bottom end 108, the first end 102 and the second end 104 of the second compartment 76 may be constructed from a material and/or materials that may provide padding to the articles 80 within the second compartment 76 and/or to the articles 80 within the first compartment 84.

In another embodiment, the top end 106, the bottom end 108, the first end 102 and the second end 104 of the second compartment 76 may be constructed from materials that may be deformable, such as, for example, nylon, foam and/or the like. The materials may be deformed to depress the second compartment 76 toward the second flap 26. Deforming the second compartment 76 toward the second flap 26 may allow for more of the first volume of the first compartment 84 to be occupied by the articles 80. It should be understood that the top end 106, the bottom end 108, the first end 102 and the second end 104 of the second compartment 76 may be constructed from any material suitable for luggage construction as known to one having ordinary skill in the art. The present invention should not be deemed as limited to a specific embodiment of the top end 106, the bottom end 108, the first end 102 and the second end 104 of the second compartment 76.

In an embodiment as shown in FIG. 4, the top end 106, the bottom end 108, the first end 102 and the second end 104 of the second compartment 76 may be attached to and/or may extend from the back side 36 of the first flap 24 in a direction toward the wall 8 of the case 2 to a point between the first flap 24 and the wall 8 of the case 2. As shown in FIG. 4, the length 87 of the second compartment 76 may be less than the lengths 92, 88, 86 of the case 2, the first flap 24 and the second flap 26, respectively; the width 95 of the second compartment 76 may be less than the widths 90, 91, 93 of the case 2, the first flap 24 and the second flap 26, respectively; and the depth 94 of the second compartment 76 may be less than the depth 96 of the case 2.

As a result, the second compartment 76 may extend into the first volume of the first compartment 84 without catching and/or snagging on the case 2 when the first flap 24 is maneuvered between an open position and/or a closed position. As shown in FIGS. 1 and 4, the articles 80 that may be stored within the second compartment 76 may be protected by the first flap 24, the second flap 26, the top end 106 of the second compartment 76, the bottom end 108 of the second compartment 76, the first end 102 of the second compartment 76, the second end 104 of the second compartment 76 and further by the walls 6, 8, 10, 12, 14, 16 of the case 2. The second compartment 76 may receive the articles 80 within the first volume of the first compartment 84 from the second flap 26 inward to the depth 94 from the second flap 26.

In an embodiment as shown in FIGS. 2 an 3, the second compartment 76 may have a divider 58 that may be sized to fit entirely within the second compartment 76. The divider 58 may have a top end 60 and a bottom end 62 that may be positioned opposite to the top end 60. The divider 58 may have a front side 64 and a back side 66 that may be positioned opposite to the front side 64. The divider 58 may be generally planar. The bottom end 62 of the divider 58 may be attached to and/or integrally formed with the bottom end 108 of the second compartment 76 between the second flap 26 and the back side 100 of the second compartment 76. The divider 58 may be constructed from a rigid material, a semi-rigid material, a pliable material, an elastic material and/or may be constructed from more than one material, such as, for example, corrugated paper, plastic, nylon, rubber, wood and/or like material for separating and/or restraining articles.

The front side 64 of the divider 58 may have one or more holders 70 and/or one or more pockets 72 for holding and/or for storing one or more of the articles 80. The divider 58 may restrict one or more of the articles 80 within the first volume of the first compartment 84 toward the back side 100 of the second compartment 76 and away from the second flap 26. AS illustrated in FIG. 2, the top end 60 of the divider 58 may be secured to the top end 106 of the second compartment 76 with a fastener 68, such as, for example, a hook and loop fastener, a snap, a button and/or the like. As a result, the divider 58 may further secure one or more of the articles 80 away from the wall 6 of the case 2 toward an interior of the case 2. The fastener 68 may be unsecured to allow access to the articles 80 stored between the back side 66 of the divider 58 and the back side 100 of the second compartment 76.

In an embodiment as illustrated in FIGS. 2 and 3, the back side 48 of the second flap 26 may have one or more holders 70 and/or pockets 72 for receiving and/or storing articles 80. The holders 70 and/or the pockets 72 may be constructed in varying sizes to secure, to organize and/or to restrain the articles 80. It should be understood that the holders 70, the pockets 72, and the fastener 68 may be any holders, pockets and/or fasteners, respectively, as known to one having ordinary skill in the art.

As illustrated in FIG. 3, a system 54 may have the case 2 and a shuttle bag 74 that may be sized to fit within the second compartment 76 that may be adjacent to the divider 58 between the back side 66 of the divider 58 and the back side 100 of the second compartment 76. The shuttle bag 74 may be, for example, a sleeve having an open end that may be sized and/or shaped to receive, for example, a laptop computer 81. In an embodiment, the shuttle bag 74 may be padded to further protect the laptop computer 81 and/or other article. The shuttle bag 74 may have a flap 75 that may be opened to receive the laptop computer 81 and/or other article and/or closed to further protect the laptop computer 81 and/or other article. It should be understood that the shuttle bag 74 may be any sleeve that may be sized to fit into the second compartment 76 between the divider 58 and the back side 100 of the second compartment 76 as known to one having ordinary skill in the art. The present invention should not be limited to a specific embodiment of the shuttle bag 74.

FIGS. 2 and 3 generally illustrate the case 2 and/or the system 54 with various articles 80. FIG. 2 generally illustrates positioning of the shuttle bag 74 between the divider 58 and the back side 100 of the second compartment 76. FIG. 3 generally illustrates insertion of the laptop computer 81 into the shuttle bag 74. FIG. 3 generally illustrates positioning of the laptop computer 81 into the shuttle bag 74 with various office-related articles 80 in the second compartment 76. After the laptop computer 81 and/or the articles 80 may be placed in the second compartment 76, the fastener 68 may secure the shuttle bag 74 as shown in FIG. 2, the second flap 26 may be secured to the first flap 24 with the fastener 29, and the second compartment 76 may be closed. Articles (not shown), such as, for example, personal belongings may be stowed in the first compartment 84.

In an embodiment, the first compartment 84 may have a bag 98 to store articles (not shown) and/or to secure articles (not shown) within the first compartment 84. As shown in FIG. 1, the first flap 24 may be secured to the case 2 with the fastener 28 to close the first compartment 84. During and/or after transportation of the laptop computer 81 and/or the articles 80 in the case 2, a traveler may access the laptop computer and/or the articles 80 in the second compartment 76 without opening the first compartment 84. The walls 6, 8, 10, 12, 14, 16 of the case 2, the material and geometry of the second compartment 76, the first flap 24, the second flap 26 and/or the shuttle bag 74 may further protect the laptop computer 81 and/or the articles 80.

It should be understood that various changes and modifications to the presently preferred embodiments described herein will be apparent to those skilled in the art. Such changes and modifications may be made without departing from the spirit and scope of the present invention and without diminishing its attendant advantages. It is, therefore, intended that such changes and modifications be covered by the appended claims.

I claim:

1. A case for storing and accessing a first type of articles and a second type of articles wherein the first type of articles are stored in and accessed from the case separately from the second type of articles, the case comprising:

a first compartment having a depth defined between a first wall and a second wall wherein the second wall is positioned opposite to the first wall wherein the compartment has a first volume defined between the first wall and the second wall to store the first type of articles;

a first flap that forms a portion of the second wall wherein the first compartment is accessible via the first flap;

a first fastener between the first wall and the second wall wherein the first fastener closes the first compartment with the first flap;

a second flap having a length defined between a top end and a bottom end wherein the bottom end of the second flap is positioned opposite to the top end of the second flap wherein the second flap has a width defined between a first end and a second end wherein the second end of the second flap is positioned opposite the first end of the second flap wherein the second flap forms a portion of the first flap wherein the bottom end of the second flap is attached to the first flap;

a second compartment accessible via the second flap having a length defined between a top end and a bottom end wherein the bottom end of the second compartment is positioned opposite to the top end of the second compartment wherein the second compartment has a width defined between a first end and a second end wherein the second end of the second compartment is positioned opposite to the first end of the second compartment wherein the second compartment has a depth defined between the second flap and a back side wherein the back side of the second compartment is positioned opposite to the second flap wherein the second compartment extends from the first flap past the first fastener into the first volume of the first compartment wherein the back side of the second compartment is positioned between the first fastener and the first wall of the first compartment wherein the second compartment is accessible without accessing the first compartment; and a divider having a length defined between a top end and a bottom end wherein the bottom end of the divider is positioned opposite to the top end of the divider wherein the bottom end of the divider is attached to the bottom end of the second compartment between the second flap and the back side of the second compartment wherein the top end of the divider is attached to the top end of the second compartment to position the second type of articles adjacent to the back side of the second compartment between the first fastener and the first wall of the first compartment.

2. The case of claim 1 further comprising:

a second fastener attaching the top end of the divider to the top end of the compartment between the second flap and the back side of the second compartment.

3. The case of claim 1 wherein the first fastener is a zipper.

4. The case of claim 1 further comprising:

a second fastener securing the first end of the second flap, the top end of the second flap and the second end of the second flap to the first flap.

5. The case of claim 1 further comprising:

a webbing attaching the first end of second flap to the first flap.

6. The case of claim 1 further comprising:

a pocket on the divider wherein the pocket has a cavity wherein the cavity stores the second type of articles.

7. The case of claim 1 further comprising:

a wheel attached to the first wall of the first compartment wherein the wheel rotates.

8. The case of claim 1 further comprising:

a bag attached to the first wall within the first compartment wherein the bag has a cavity to store the first type of articles.

9. A system for transporting a plurality of articles wherein one of the plurality of articles is separated from a remainder of the plurality of articles and is accessible without accessing the remainder of the plurality of articles, the system comprising:

a case having a first volume defined by a plurality of walls wherein the first volume of the case is accessible via one of the plurality of walls wherein at least two of the plurality of walls of the case are attached by a first fastener;

a compartment having a depth defined between one of the plurality of walls of the case and a back side of the compartment wherein the back side of the compartment is positioned opposite to one of the plurality of walls of the case wherein the compartment has a second volume wherein the compartment extends into the case penetrating the first volume wherein the first fastener is positioned at a point along the depth of the compartment between the back side of the compartment and one of the plurality of walls wherein the second volume is less than the first volume wherein the compartment is accessible via one of the plurality of walls;

a divider having a top end and a bottom end wherein the bottom end of the divider is positioned opposite to the top end of the divider wherein the bottom end of the divider and the top end of the divider are attached to an interior of the compartment between one of the plurality of walls and the back side of the compartment wherein the divider separates the compartment into a front portion and a rear portion wherein the rear portion is adjacent to the back side of the compartment wherein the first fastener is positioned between the rear portion and the front portion and further wherein the front portion is adjacent to one of the plurality of walls of the case; and a bag to receive one of the plurality of articles wherein the bag is sized to fit within the rear portion of the compartment between the divider and the back side of the compartment.

10. The system of claim 9 wherein the first fastener is a zipper.

11. The system of claim 9 further comprising:

a flap formed with one of the plurality of walls wherein the flap has a top end and a bottom end wherein the bottom end is positioned opposite to the top end wherein the flap has a first end and a second end wherein the second end is positioned opposite to the first end wherein the bottom end is attached to one of the plurality of walls wherein the top end of the flap, the first end of the flap and the second end of the flap have a second fastener securing the flap to one of the plurality of walls wherein the second fastener is disengaged to access the compartment.

12. The system of claim 9 further comprising:

an opening in the bag wherein the opening is sized to receive one of the plurality of articles.

13. The system of claim 9 further comprising:

a padded material forming the bag wherein the padded material is compressible.

14. The system of claim 9 further comprising:

a padded material forming the compartment wherein the padded material is compressible.

15. The system of claim 9 further comprising:

a non-rigid material forming the compartment wherein the back side of the compartment is movable toward one of the plurality of walls of the case.

16. The system of claim 9 further comprising:

a second fastener attaching the top end of the divider to the interior of the compartment.

17. A method for storing a plurality of articles in a case wherein the case has a main compartment accessible by a first flap attached to the case with a fastener and a volume defined by a plurality of walls of the case wherein the case has a secondary compartment accessible by a second flap located on the first flap wherein the secondary compartment extends from the second flap into the volume of the main compartment to a back side of the secondary compartment wherein the fastener is positioned between the second flap and the back side of the secondary compartment wherein the main compartment is not accessible via the secondary compartment and further wherein the case has a divider to segregate the second compartment, the method comprising the steps of:

opening the main compartment with the first flap;

placing one of the plurality of articles in the main compartment;

closing the main compartment with the first flap;

opening the secondary compartment with the second flap;

placing one of the plurality of articles within the secondary compartment in a position adjacent to the back side of the secondary compartment between the back side of the secondary compartment and the fastener and entirely within the volume of the main compartment;

securing the divider to the secondary compartment in a position between the fastener and the back side of the secondary compartment to restrict movement of the article away from the back side of the secondary compartment and outside the volume of the main compartment; and closing the secondary compartment with the second flap.

18. The method of claim 17 further comprising the step of:

securing the second flap to the first flap.

19. The method of claim 17 further comprising the step of:

compressing the secondary compartment to increase the volume of the main compartment.

20. The method of claim 17 further comprising the step of:

securing the first flap to one of the plurality of walls.

* * * * *